US006413132B1

(12) United States Patent
Swanson

(10) Patent No.: US 6,413,132 B1
(45) Date of Patent: Jul. 2, 2002

(54) LIFE RAFT INFLATION VALVE

(75) Inventor: Robert L. Swanson, Ham Lake, MN (US)

(73) Assignee: Survival Engineering, Inc., Oakdale, MN (US)

( * ) Notice: Subject to any disclaimer, the term of this patent is extended or adjusted under 35 U.S.C. 154(b) by 0 days.

(21) Appl. No.: 09/819,807

(22) Filed: Mar. 28, 2001

(51) Int. Cl.[7] ..... B63B 35/58
(52) U.S. Cl. ..... 441/41; 251/294; 441/96
(58) Field of Search ..... 251/294; 441/41, 441/96

(56) References Cited

U.S. PATENT DOCUMENTS 3,570,805 A * 3/1971 Moran ..... 251/38
4,595,374 A 6/1986 Wass
5,188,142 A 2/1993 Lind et al.

* cited by examiner

*Primary Examiner*—Ed Swinehart

(57) ABSTRACT

A life raft inflation valve has a body with a bore extending therethrough. A threaded gas intake fitting is on the body and communicates with the bore. An elongated valve spool is slidably mounted in the bore and normally closes the gas intake fitting. A lanyard is operatively connected within the lanyard fitting to the spool for longitudinally moving the spool in the bore to open the gas intake fitting. A lanyard fitting has a rounded or flared shoulder at its discharge end to facilitate the longitudinal movement of the spool by pulling on the lanyard even if it is pulled outwardly at an angle to the center axis of the bore.

12 Claims, 6 Drawing Sheets

LIFE RAFT INFLATION VALVE

BACKGROUND OF THE INVENTION

Common shortcomings of existing raft inflation valves are particularly shown by U.S. Pat. No. 4,595,374 issued Jun. 17, 1986. First of all, such valves have a high profile wherein various passageways intersect, thus complicating its control and operation. The air flow passages are restricted, thus inhibiting the inflation rate of the raft. Further, the pull lanyard on the valve is difficult to pull.

It is therefore a principal object of this invention to provide a raft inflation valve that has a low longer profile to prevent passageways from interfering with each other, and which will permit increased air flow capacity.

A further object of the invention is to provide a raft inflation valve wherein the lanyard is automatically positioned towards the direction of pull to facilitate the pulling thereof.

These and other objects will be apparent to those skilled in the art.

SUMMARY OF THE INVENTION

A raft inflation valve has a valve body with opposite flat top and bottom surfaces. The valve body is in the shape of a hexagon and has three pairs of oppositely disposed vertical sidewalls. An internally elongated bore extends through the valve body in a direction between and parallel to the flat top and bottom surfaces.

A threaded hollow gas intake fitting extends from one flat surface of the body and communicates with a center of the bore. An elongated valve spool is slidably mounted in the bore and normally closes the gas intake fitting.

A lanyard is operatively connected within the lanyard fitting to the spool for longitudinally moving the spool in the bore to open the gas intake fitting. A lanyard fitting has a rounded or flared shoulder at its discharge end to facilitate the longitudinal movement of the spool by pulling on the lanyard even if it is pulled outwardly at an angle to the center axis of the bore.

A detachable lock element is associated with the lanyard for preventing the lanyard from moving the spool to open the gas intake fitting. A gas discharge port assembly is on the body at the end of the bore opposite the lanyard for connection to a raft to be inflated.

DESCRIPTION OF THE PREFERRED EMBODIMENT

Figure 1:
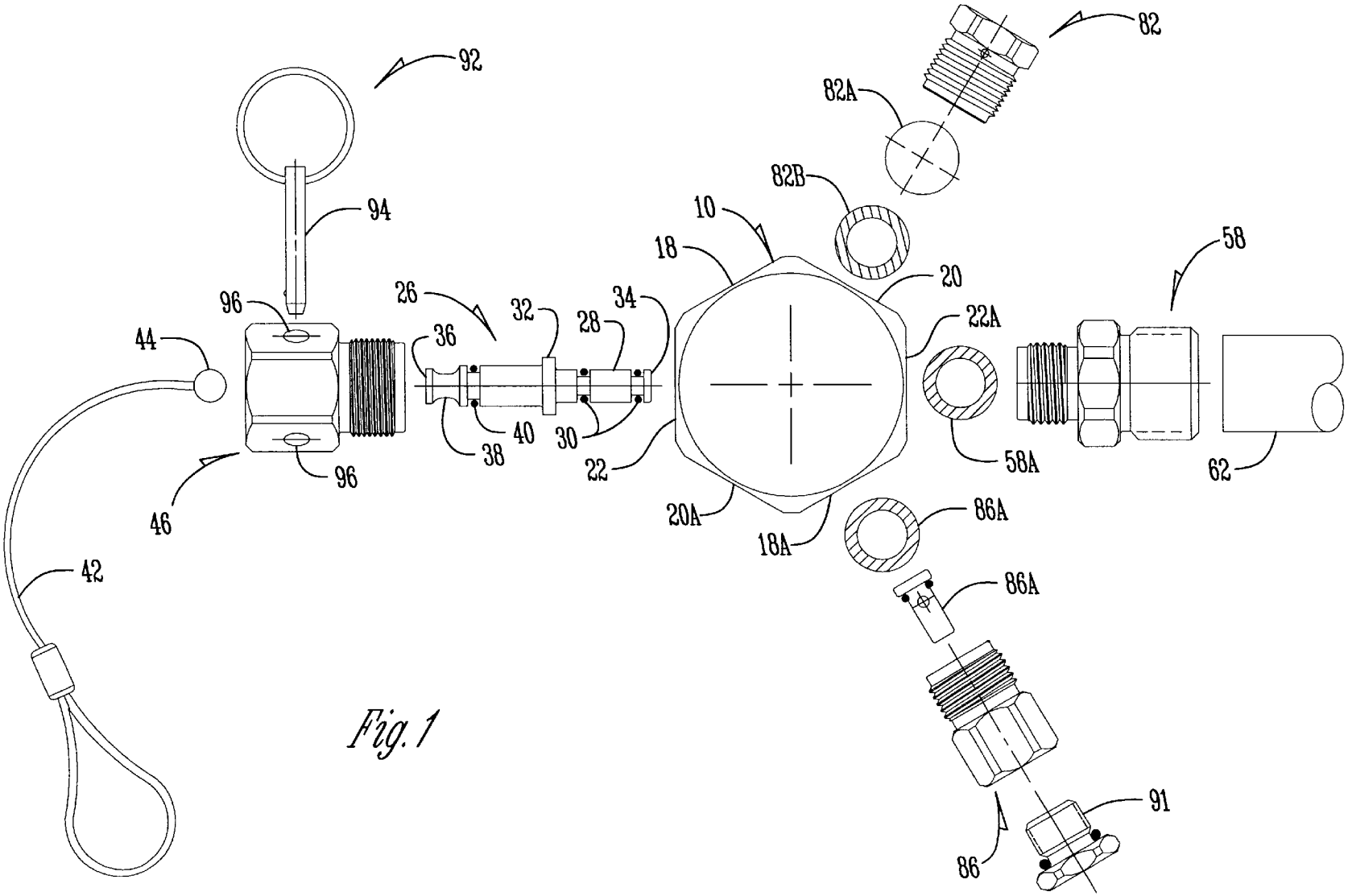
FIG. 1 is an exploded top plan view of the raft inflation valve of this invention.
Figure 2:
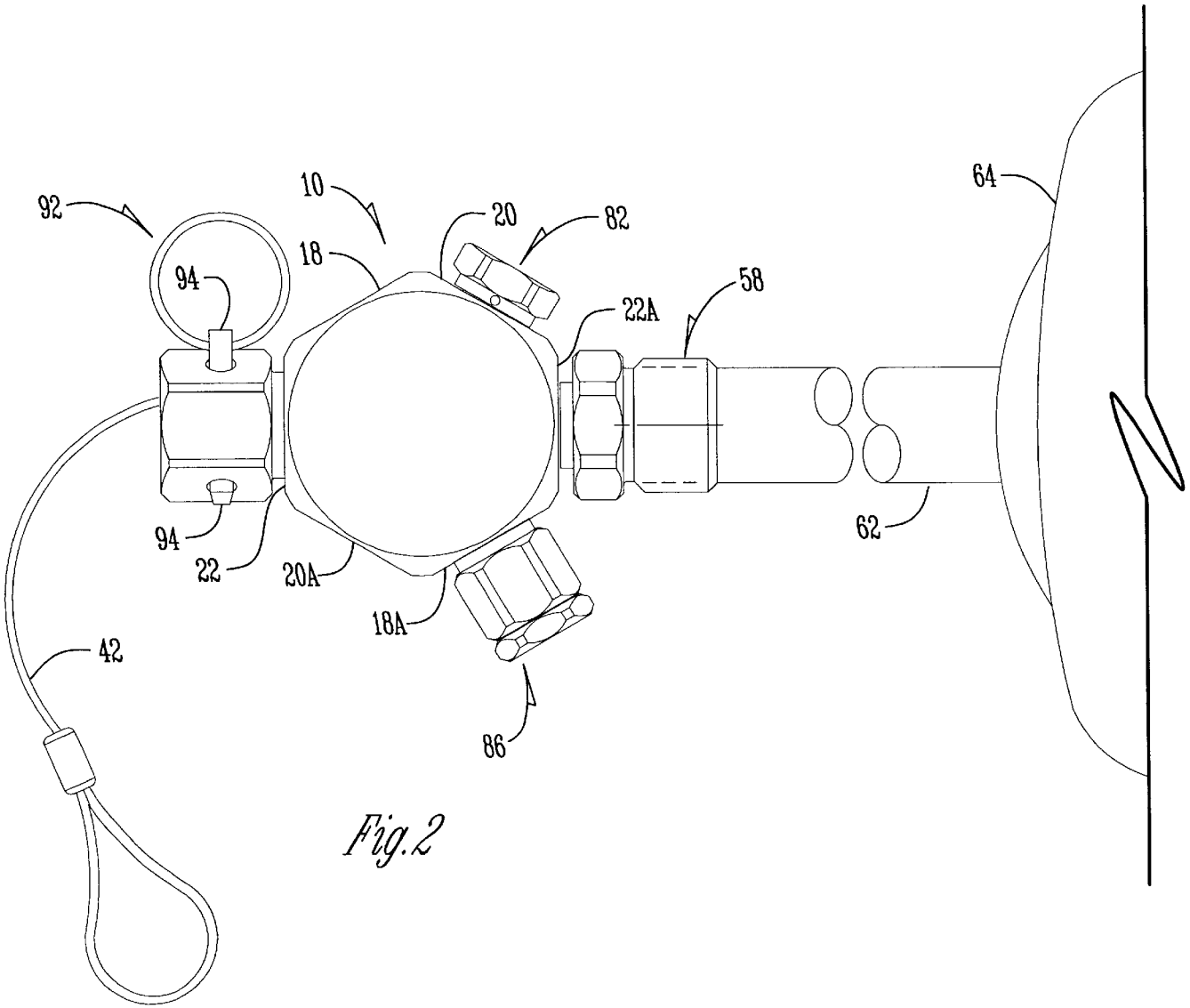
FIG. 2 is a view similar to that of FIG. 1 but shows the components of FIG. 1 in an assembled condition.
Figure 3:
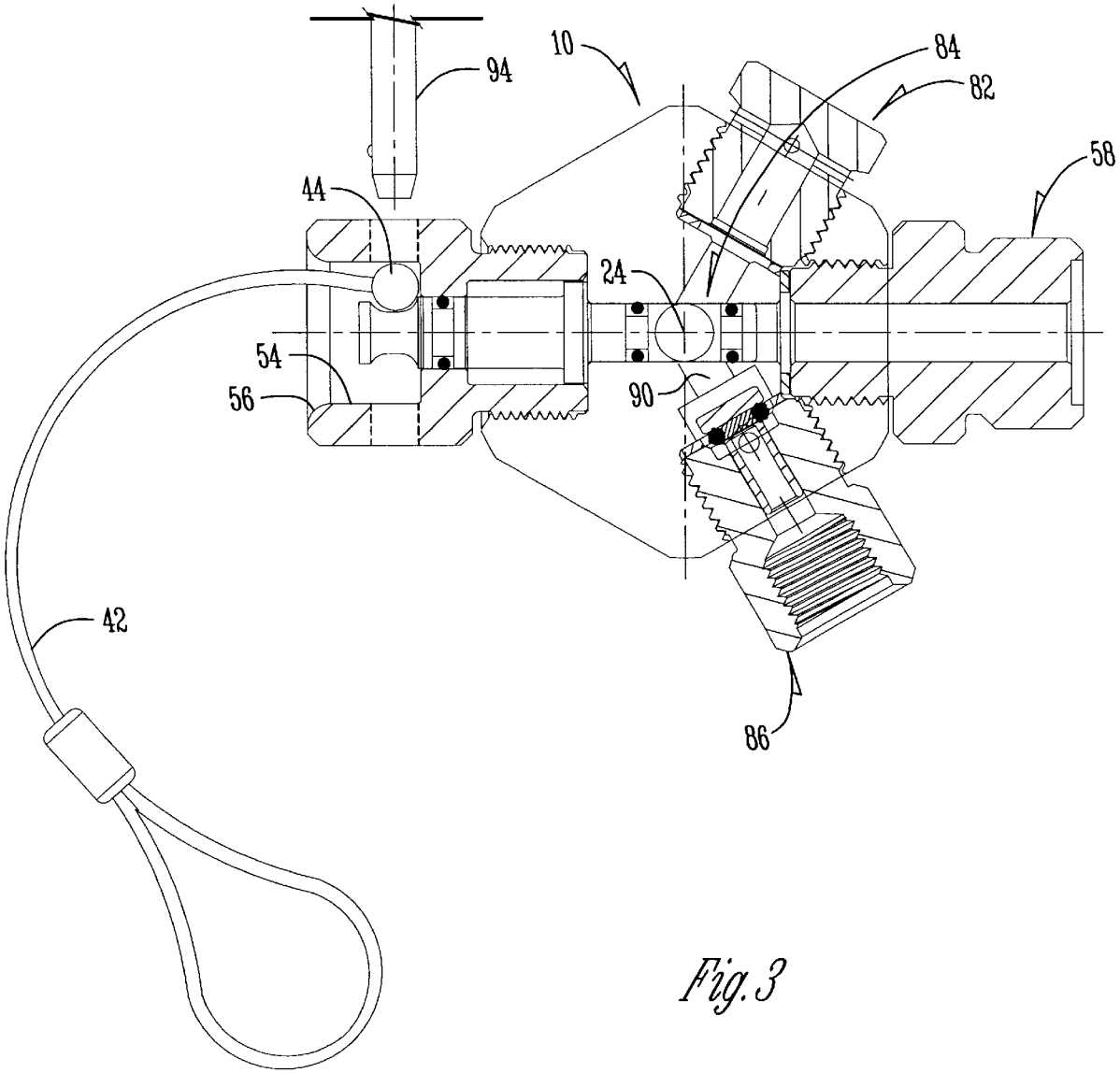
FIG. 3 is a horizontal sectional view of the assembled components of FIG. 2.
Figure 4:
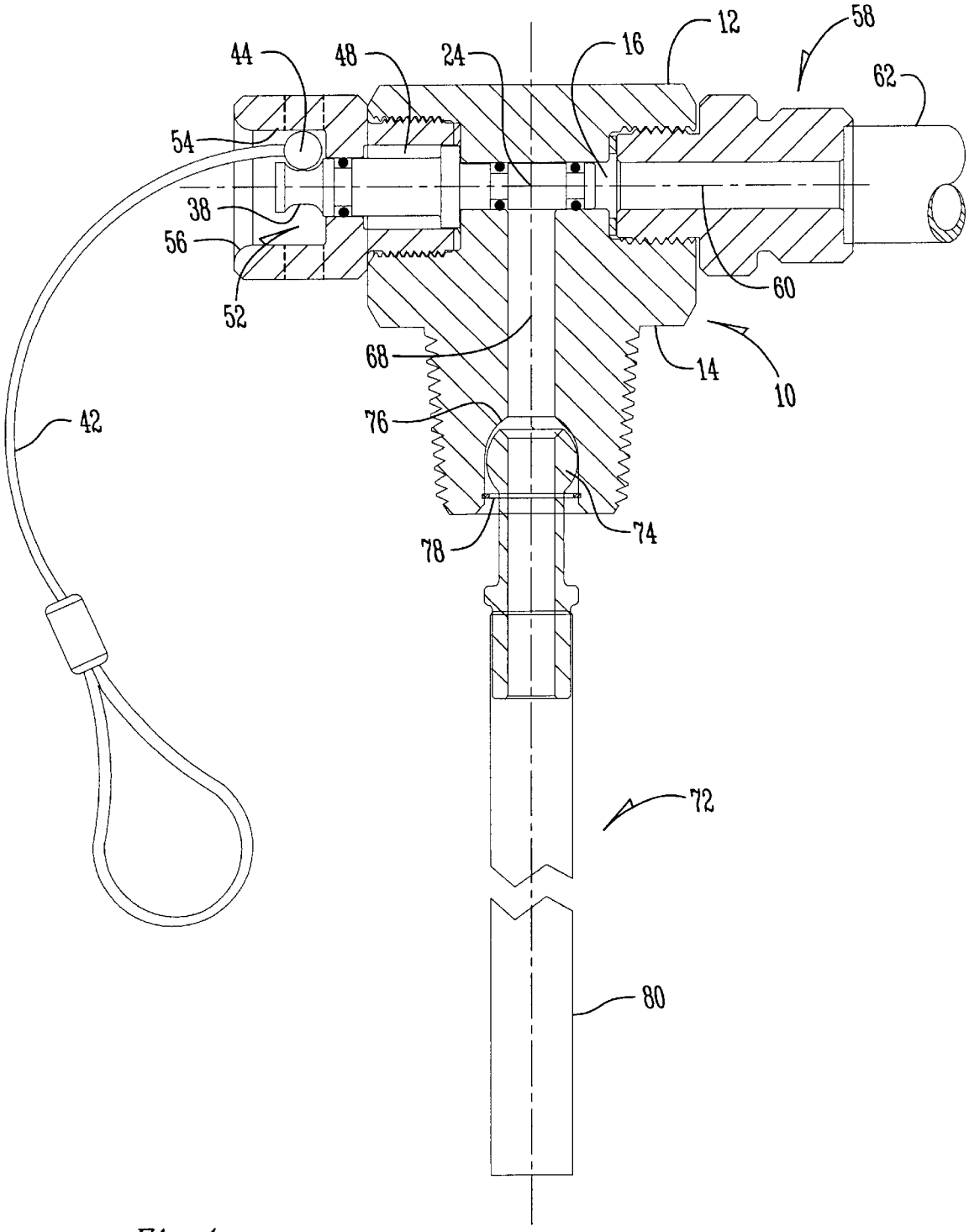
FIG. 4 is a vertical sectional view through the assembled components of FIG. 3.
Figure 6:
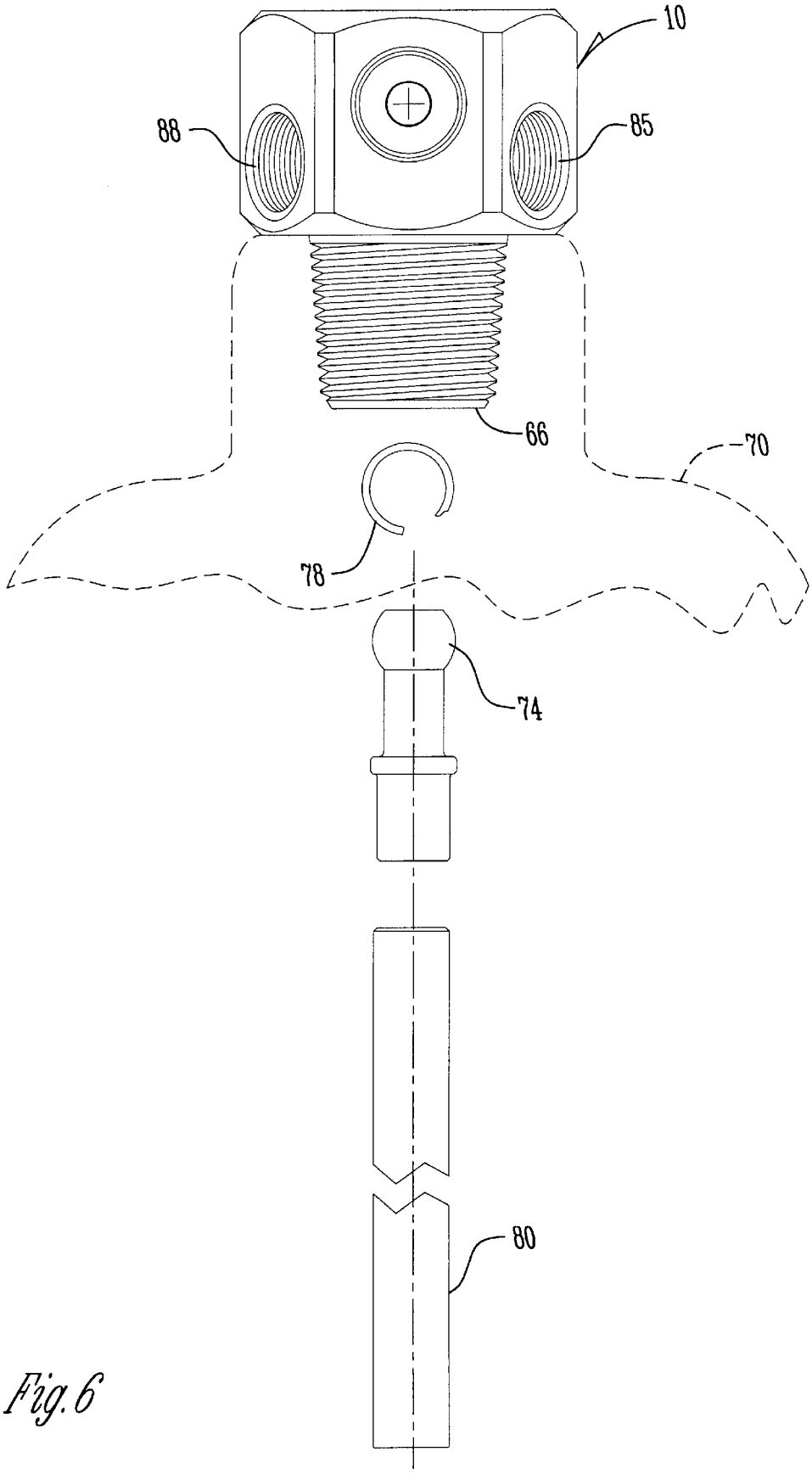
FIG. 6 is a side elevational view of the valve body with a swivel tube attached for extension into a container of compressed gas.

The valve body 10 as shown in FIG. 6 has a hexagonal shape with a flat top wall 12 and a bottom flat wall 14. A horizontal center bore extends through body 10 as best shown in FIG. 4. The body 10 has three pairs of sidewalls with opposite sidewalls 18 and 18A; 20 and 20A; and 22 and 22A (FIGS. 1–3). The numeral 24 in FIGS. 3 and 4 designate the center of bore 16.

A valve spool 26 is slidably mounted in bore 16. With reference to FIG. 1, spool 26 has a valve portion 28, with a pair of O-rings 30 at opposite sides thereof. The numeral 32 designates a shoulder adjacent the valve portion 28. The numerals 34 and 36 designate the inner and outer ends of spool 26, respectively. A concave annular groove 38 is formed adjacent the outer end 36 of spool 26. An O-ring 40 is located immediately inboard and adjacent the annular groove 38.

A conventional lanyard 42 has a ball 44 on one end as best shown in FIGS. 1, 3 and 4. A lanyard fitting 46 is threadably mounted in body 10 as best shown in FIG. 3. The lanyard fitting 46 has a first bore 48 of relatively small diameter. Bore 48 communicates with a second bore 50 of a greater diameter. An annular space 52 (FIG. 3) is located around the concave annular groove 38 and is defined by the concave annular groove and the inner wall 54 of the second bore 50. The second bore 50 terminates in a flared or rounded shoulder 56.

As shown in FIG. 4, a gas discharge port assembly 58 has a center bore 60 and has a hose 62 secured to the outer end thereof which communicates with the interior of hollow liferaft 64 (FIGS. 2 and 4). The gas discharge port assembly 58 is located at the end of bore 16 in valve body 10 opposite to the lanyard fitting 46. Sealing washer 58A seals the connection of assembly 58.

As seen in FIGS. 4 and 6, a gas intake fitting 66 with external threads extends "downwardly" from the bottom surface 14 of body 10. A center bore 68 is located within fitting 66 and communicates with a pressurized gas tank 70 (FIG. 6). A conventional swivel tube 72 is connected to the open end of fitting 66 and is secured to the fitting 6 by means of a ball 74 which fits within ball socket 76 in fitting 66. This connection is completed by snap ring 78 (FIG. 4). A conventional extension tube 80 is secured to the lower end of swivel tube 72 so as to extend towards the bottom interior end of the tank 70.

A conventional pressure relief valve 82 with a conventional diaphragm 82A and washer 82B communicates with bore 16 via passageway 84. The valve 82 is threadably inserted into the body 10 in threaded aperture 85 (FIG. 6).

A conventional gas charging fitting 86 (FIG. 3) with a conventional plunger 86A and washer 86B is threaded into aperture 88 (FIG. 6) of body 10. A passage 90 connects the interior of fitting 86 with the bore 16 in body 10. A conventional plug 91 can be used to close fitting 86 when it is not being used.

A locking pin 92 (FIGS. 1, 2 and 3) has an elongated shaft 94 which can be inserted through apertures 96 in lanyard fitting 46. Shaft 94, when inserted through apertures 96 is adapted to enter the concave annular groove 38 in spool 26 to hold the spool against longitudinal movement and to prevent the lanyard 42 from moving the spool.

Figure 5:
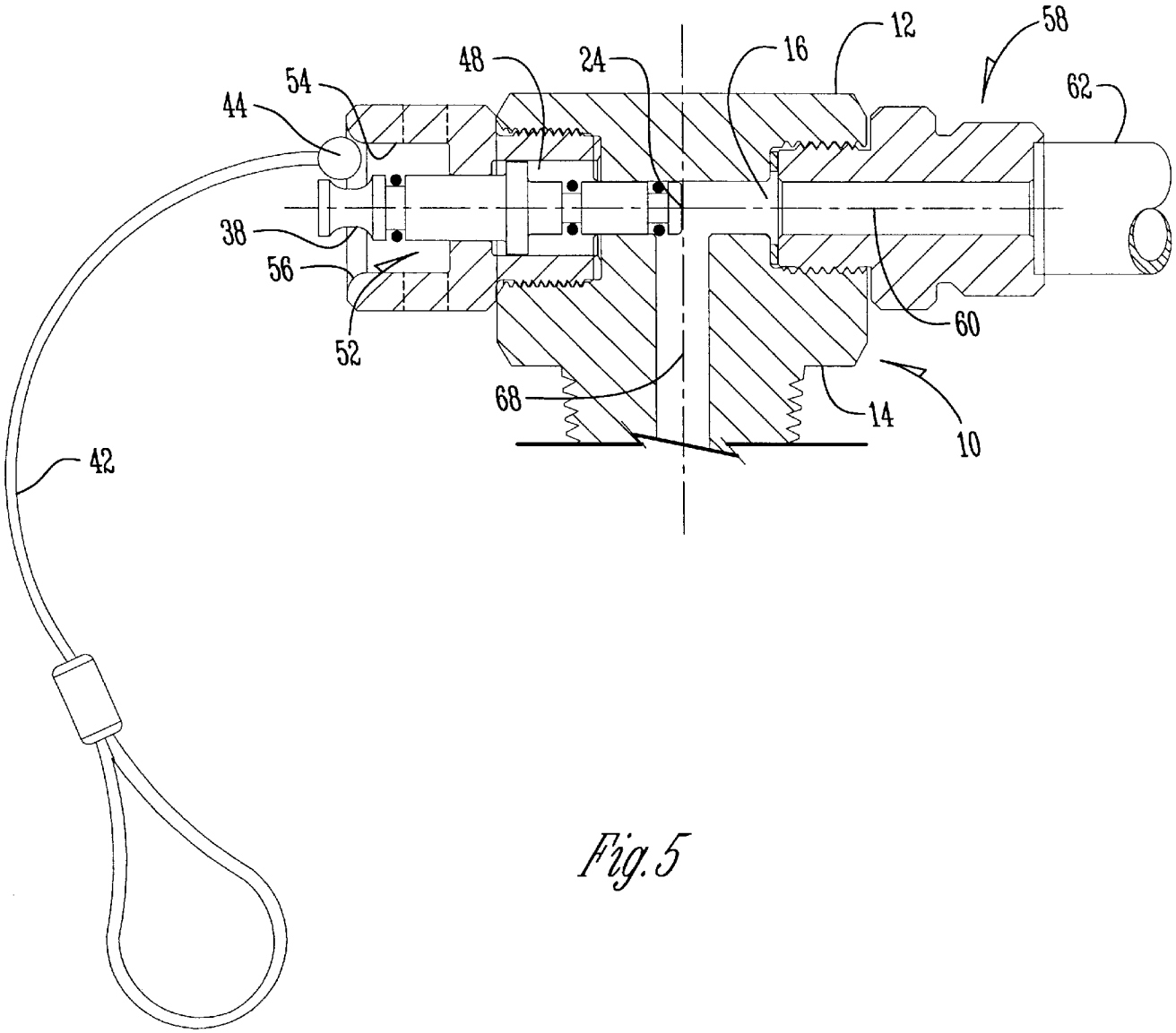
FIG. 5 is a partial view of the upper portion of FIG. 4 but shows the spool of the valve in a gas discharge position.

In operation, a tank 70 contains pressurized gas. Before usage, the components of the valve are in the positions shown in FIGS. 3 and 4. When it becomes necessary to inflate the raft 64, the operator removes pin 92 and pulls outwardly on the lanyard 42 which causes the spool 26 to move from the position in FIG. 4 to the position of FIG. 5. This allows pressurized gas to flow through the bore 16 in the direction of the arrows shown in FIG. 5 to inflate the raft as the pressurized gas moves through fitting 58 and hose 62 into the interior of the raft.

It should be noted that the lanyard 46 can successfully move the spool 26 regardless of the direction of pull of the lanyard. This is because the ball 44 on the lanyard 42 can move 360° around the concave annular groove 38 when the safety pin 92 is removed. Further, there is no tube or enclosure surrounding the lanyard 42 to inhibit its being pulled in an outward direction with respect to the outer end of the spool 26. The flared or rounded shoulder 56 facilitates this result.

The fitting 86 can be used to supply compressed air or gas to the tank 70. The pressure relief valve 82 will function in conventional fashion in the event that the internal gas pressure within the valve exceeds the resistance of pressure relief diaphragm 82A. Again, both the fittings 82 and 86 are of conventional construction.

By reason of the compact construction of the valve of this invention, the diameter of bore 16 can be increased to a dimension in the order of 0.25 inches so that a large quantity of compressed gas can be directed to the raft very quickly. This permits rafts of large construction, (those holding six or more people) to be quickly and efficiently inflated.

From the foregoing, it is seen that this invention will accomplish at least all of its stated objectives.

What is claimed is:

1. A raft inflation valve, comprising, a valve body having opposite flat surfaces, and a sidewall, an internal elongated bore in the valve body extending in a direction between and parallel to the flat surfaces, a threaded hollow gas intake fitting extending from one flat surface of the body and communicating with a center of the bore, an elongated valve spool in the bore normally closing the gas intake fitting, a lanyard fitting on one end of the bore and having a flared opening therein, a lanyard operatively connected within the lanyard fitting to the spool for longitudinally moving the spool longitudinally in the bore to open the gas intake fitting by pulling the lanyard longitudinally outwardly, with the lanyard being free to extend over a rounded shoulder on the flared fitting to facilitate longitudinal movement thereof even if pulled outwardly at an angle to a center axis of the bore, a detachable lock element associated with the lanyard for preventing the lanyard from moving the spool to open the gas intake fitting, and a gas discharge port assembly on the body at the end of the bore opposite the lanyard for connection to a raft to be inflated.

2. The raft inflation valve of claim 1 wherein the body is hexagonal in shape to define three pairs of opposite sidewalls, and wherein the lanyard fitting is mounted on one sidewall of the opposite pairs of sidewalls.

3. The raft inflation valve of claim 2 wherein a pressure relief valve is mounted in another of the sidewalls of another one of the pairs of opposite sidewalls, the pressure relief valve being normally closed and being in communication with the center of the bore.

4. The raft inflation valve of claim 3 wherein a normally closed gas charge valve is mounted in yet another of the sidewalls of another one of the pairs of sidewalls, and being in communication with the bore to permit gas under pressure to be forced therethrough into and through the spool into the hollow gas intake fitting when the pressure relief valve is closed and the lanyard has not been pulled outwardly from the lanyard fitting.

5. The raft inflation valve of claim 1 wherein the spool has opposite seal rings adjacent a center portion thereof to close the flow of gas inwardly through the hollow gas intake fitting when the lanyard has not been pulled outwardly from the lanyard fitting.

6. The raft inflation valve of claim 1 wherein the spool has an annular concave-shaped recess on an end thereof normally positioned within the lanyard fitting, a spherically-shaped ball connected to an inner end of the lanyard and loosely positioned within an annular space around the recess on the spool within a bore in the lanyard fitting, and being restricted against movement from the bore until the recess on the spool has been pulled longitudinally adjacent the rounded shoulder of the flared fitting.

7. The raft inflation valve of claim 6 wherein the ball is normally loosely confined within the lanyard fitting between a sidewall of the bore in the lanyard fitting, and the annular concave recess on the end of the spool.

8. The raft inflation valve of claim 1 wherein a gas discharge fitting for operative connection to a raft is mounted in an end of the bore in the valve body opposite to the lanyard fitting.

9. The raft inflation valve of claim 8 wherein the body is hexagonal in shape to define three pairs of opposite sidewalls, and wherein the lanyard fitting is mounted on one sidewall of the opposite pairs of sidewalls.

10. The raft inflation valve of claim 9 wherein a pressure relief valve is mounted in another of the sidewalls of another one of the pairs of opposite sidewalls, the pressure relief valve being normally closed and being in communication with the center of the bore.

11. The raft inflation valve of claim 10 wherein a normally closed gas charge valve is mounted in yet another of the sidewalls of another one of the pairs of sidewalls, and being in communication with the bore to permit gas under pressure to be forced therethrough into and through the spool into the hollow gas intake fitting when the pressure relief valve is closed and the lanyard has not been pulled outwardly from the lanyard fitting.

12. The raft inflation valve of claim 1 wherein the bore in the valve body has an effective diameter of approximately 0.25 inches.

* * * * *